United States Patent [19]

Ploppa et al.

[11] Patent Number: 4,774,818

[45] Date of Patent: Oct. 4, 1988

[54] DEVICE FOR DETERMINING THE POSITION OF THE DRAW-DOWN ELEMENTS IN FLAT-BED KNITTING MACHINES

[75] Inventors: Jürgen Ploppa, Pfullingen; Franz Schmid, Bodelshausen; Hans-Günter Haltenhof, Pfullingen, all of Fed. Rep. of Germany

[73] Assignee: H. Stoll GmbH & Co., Fed. Rep. of Germany

[21] Appl. No.: 92,543

[22] Filed: Sep. 3, 1987

[30] Foreign Application Priority Data

Sep. 4, 1986 [DE] Fed. Rep. of Germany ..... 3630051

[51] Int. Cl.[4] ..... D04B 7/00

[52] U.S. Cl. ..... 66/71; 66/78

[58] Field of Search ..... 66/71, 78

[56] References Cited

U.S. PATENT DOCUMENTS

| | | | |
|---|---|---|---|
| 4,502,300 | 3/1985 | Schimko et al. | 66/71 |
| 4,510,775 | 4/1985 | Shima | 66/78 |
| 4,526,017 | 7/1985 | Shima | 66/71 |
| 4,554,802 | 11/1985 | Goller et al. | 66/71 |
| 4,686,838 | 8/1987 | Stoppazzini | 66/71 |
| 4,723,423 | 2/1988 | Goller et al. | 66/71 |

*Primary Examiner*—Ronald Feldbaum

*Attorney, Agent, or Firm*—Jones, Tullar & Cooper

[57] ABSTRACT

A device for the determination of the position of leading or trailing draw-down elements which can be shifted to operated in opposite directions in flat-bed knitting machines has a single step motor for shifting the draw-down elements, a position sensor and a switching element movable in relation to each other and cooperating with each other, the switching element indicating a basic position of the two draw-down elements. So that in such a device besides the basis position of the two draw-down elements the shifted position, i.e. which of the two draw-down elements is in the draw-down position, can be machine-internally determined, a second switching element is provided, which is operationally connected with the position sensor, the second switching element and the position sensor being movable in relation to each other and the second switching element being synchronously movable with the first switching element. Furthermore, the second switching element is associated with one of the two draw-down elements for the determination of the switched position of the two draw-down elements.

9 Claims, 2 Drawing Sheets

FIG.1
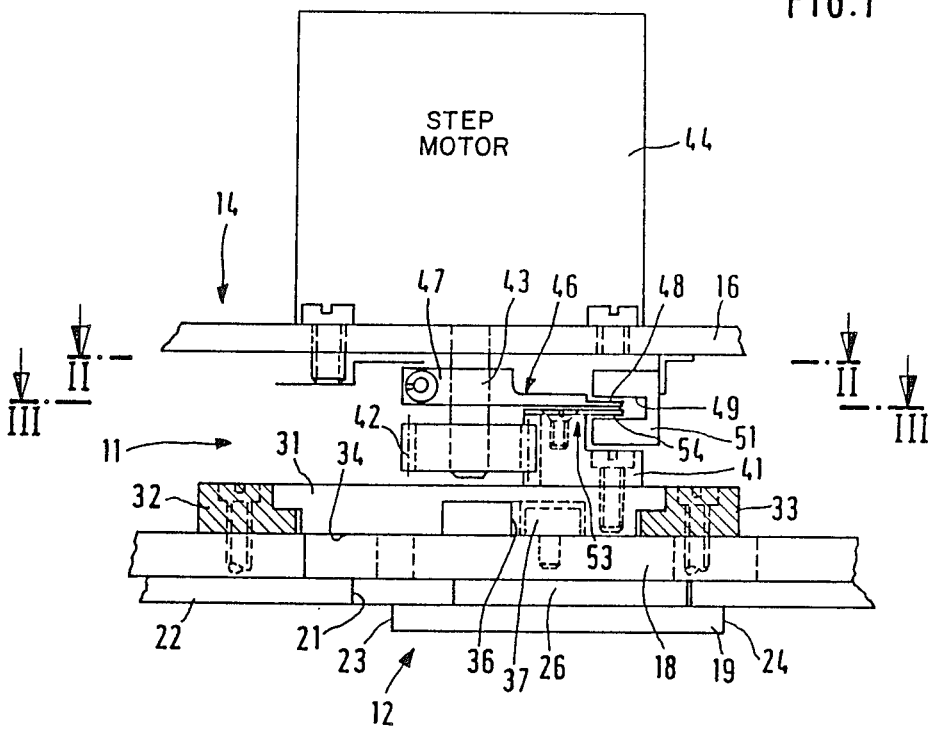
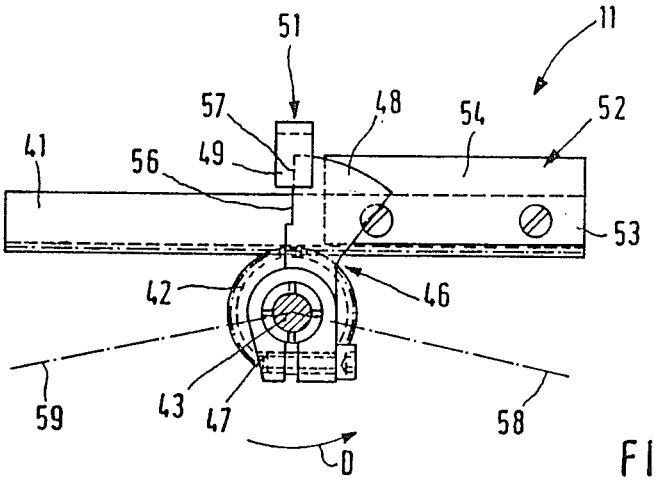
FIG. 2

DEVICE FOR DETERMINING THE POSITION OF THE DRAW-DOWN ELEMENTS IN FLAT-BED KNITTING MACHINES

FIELD OF THE INVENTION

The invention relates to a device for determining the position of leading or trailing draw-down elements which can be shifted to operate in opposite directions in flat-bed knitting machines with a single step motor for shifting the draw-down elements, with a position sensor and a switching element movable in relation to each other and cooperating with each other, the one switching element indicating a basic position of the two draw-down elements.

BACKGROUND OF THE INVENTION

In such a device known from German Laid-open Application No. DE-OS 32 45 230 a single switching element, provided as a shift finger, is connected with the drive shaft of the step motor via a graduated collar, the graduated collar being surrounded by a fixed disk having a vernier scale. The rotating shift finger extends through a U-shaped position sensor, the device being set such that in the basic position of the two draw-down elements the leading edge of the shift finger crosses the working line of the position sensor and that in this position the zero point of the graduated collar overlies the zero point of the vernier scale. With this device it is possible to record the basic position of the draw-down elements during each shifting movement to compare it with the position of the two scales so that changes can be recorded. However, the exact recordation of the basic position of the draw-down elements depends on the permissible tolerances and the permissible play of the gear transmission between the step motor and the draw-down elements. Even though it is possible to record with this known device the opposite shifting of the two draw-down elements from the one direction to the other during lift reversal of the carriage at random places on the needle butt or butts, the known device is not capable of automatically or machine-internally determining, for example during an unforeseen outage of the machine after reactivation, which one of the draw-down elements is now in the draw-down position and which one is in the alignment position, i.e., in a position where the head of the needle is in alignment with the knock-over edge of the comb. This can only be read off from the two scales by the operator of the flat-bed knitting machine.

SUMMARY OF THE INVENTION

It is an object of the present invention to provide a device of the type described above by means of which it is possible to determine machine-internally, besides the basic position of the two draw-down elements, also the shifted position, i.e., which of the two draw-down elements is in the draw-down position.

This object is attained in a device of the type described by means of two switching elements and a position sensor. Both switching elements are movable in synchronism with one switching element indicating the basic position of the draw-down elements and the other switching element indicating the shifted position of the two draw-down elements.

Because the second switching element signals, depending on whether it is being touched by the position sensor or not, which of the two draw-down position, it can be determined internally in the machine in what direction the step motor must be operated for increasing or decreasing the tightness of the loops or for reversing the lift. If, for example, an interruption should occur during operation of the flat-bed knitting machine, the machine can, after reactivation, easily determine on its own which one of the draw-down elements is in the draw-down position, from which the respective lift direction of the carriage can be determined. This determination of the position can take place additionally to the determination of the basic position of the two draw-down elements. It is also possible by the combination of the two switching elements to equalize the lag of the rotor of the motor with respect to the magnetic field when only one phase of a multi-phase motor is used, since only the position after the final oscillation is of importance.

To account for tolerances and possible play in the device it is expedient for the two switching elements practically to overlap each other over a partial area.

In the device accordingly to German Laid-open Application No. DE-OS 32 34 230 a rack and pinion connection between the step motor and the draw-down elements is used such that each draw-down element has its own associated pinion, which two pinions act on the respective draw-down element to move it into the draw-down position. The device of a position sensor and switch finger is away from this rack and pinion connection, i.e., it is provided on the end away from the step motor. In contrast to this a simpler and less expensive device with only a single rack is provided in an exemplary embodiment of the present invention in that the movement of the draw-down elements is caused by the reciprocal movement of a single rack to which the second switching element is rigidly coupled, the second switching element having a length corresponding to a partial length of the rack, and in that the first switching element is fixed against rotation with the drive shaft of the step motor in the area of the pinion. By means of this step it has further become possible that the two switching elements can be brought close to each other and associated with a single position sensor. Because the second switching element only extends across part of the length of the rack of the position sensor can determine which of the two draw-down elements is in the draw-down position by the presence or absence of the second switching element.

By providing the first switching element in the shape of a disk and as a circular segment, and the second switching element in the shape of a rectangular plate so that the disk and plate overlap in the position which determines the basic position of the draw-down elements, it becomes possible that by simple but different basic movements of the two switching elements their overlapping is only possible in a certain desired area.

The area of overlap of the first and second switching elements is greater than the maximum play of the rack and pinion linkage and maximally permissible tolerance. This makes it possible to compensate for tolerances in the device and for the play present in the rack and pinion connection.

The rack is rigidly connected with a link plate with which guide elements of the draw-down elements interact. As a result the rack acts directly in a simple manner on a cam by means of which the draw-down elements can be shifted in oppostion to each other.

Further details of the invention can be seen in the subsequent description in which the invention is described and explained in detail in means of the exemplary embodiment shown in the drawings.

BRIEF DESCRIPTION OF THE DRAWINGS

FIG. 1 is a schematic longitudinal section of a device for determining the position of the draw-down elements according to a preferred exemplary embodiment of the present invention, FIG. 2 is a section line II—II of FIG. 1, however, without the underlying parts of the cam carriage.

DETAILED DESCRIPTION OF THE PREFERRED EMBODIMENT

Figure 3:
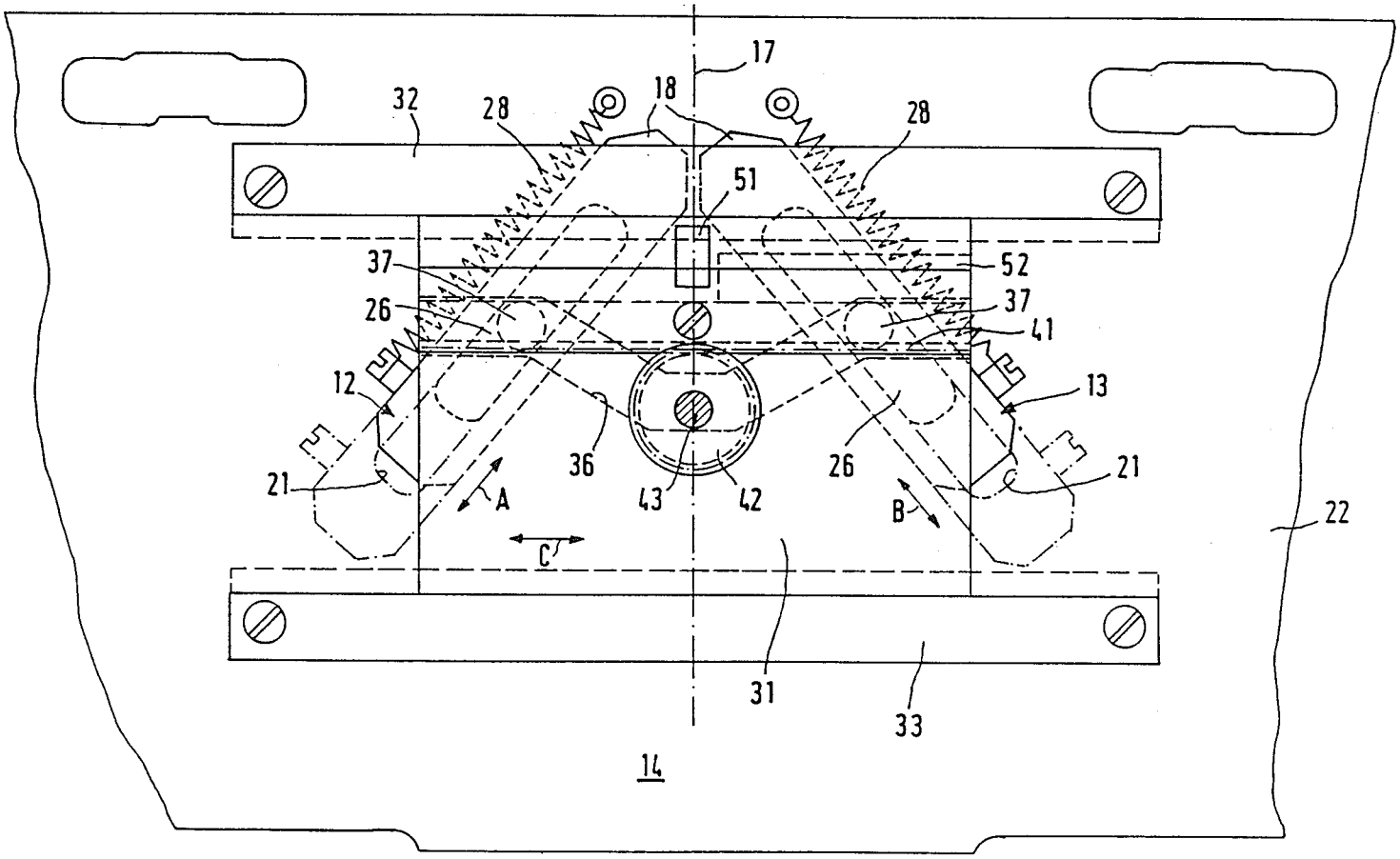
FIG. 3 is a top view along the line II—II of FIG. 1.

The device 11 accordingly to the present invention is intended for determining not only the zero or basic position of opposing, adjustable pairs of draw-down elements, one of the elements comprising a leading and the other a trailing casting-off element 12, 13 in a cam carriage 14 of a flat-bed knitting machine, but also to determine which of the two draw-down elements 12, 13 of each pair is in the draw-down position and which remains in the alignment, i.e., in the basic position.

In accordance with FIG. 3, which shows a top view of a cam carriage 14 below a cover plate 16 (FIG. 1), the draw-down elements 12 and 13 are disposed symmetrically with respect to a center line 17 opposing each other in the form of a V. The draw-down elements 12, 13 have a top plate 18 and a bottom plate 19 having respective needle butt tracks 23, 24 for the needles, between which a guide strip 26 is disposed which is movably guided in an oblique slit 21 of the cam carriage 14 and moves back and forth, i.e., reciprocates, in the direction of the double arrows A or B. The draw-down elements 12, 13 as a whole are pre-stressed by a tension spring 28, one end of which is fastened in place and the other on the top plate 18 and which retracts the draw-down elements 12, 13 into the alignment position (FIG. 1).

The reciprocating movement of the draw-down elements 12, 13 is accomplished by means of a horizontally, i.e., in the direction of the double arrow C, moveable link plate 31 disposed above the draw-down elements 12, 13 and movably guided back and forth between two fixed parallel strips 32, 33. On its underside 34 oriented towards and abutting the top plate 18 of the casting-off elements 12, 13, the link plate 31 is provided with cam 36, shown in FIG. 3, which is approximately V-shaped and provided with a central horizontal branch and two lateral horizontal branches. A link block 37, for example in the form of a roller bearing, is guided in this cam 36 which is fixed protruding from the opposite surface of the top plate 18. Thus, by means of a reciprocating movement of the link plate 31 in accordance with the double arrow C, of the draw-down elements 12, 13 can be moved in the direction of the double arrow A or B, while the other of the draw-down elements 12, 13 can be moved in the opposite direction or remains at the comb level.

To move the link plate 31, it is fixedly connected with a rack 41 extending in the direction of the double arrow C. The rack 41 disposed on the side of the link plate 31 oriented away from the draw-down elements 12, 13 meshes with a pinion 42 fixed against relative rotation on the drive shaft 43 of a drive motor, preferably of a step motor 44. The step motor 44 is fixed on the cover plate 16 of the cam carriage 14 on the above described longitudinal center line 17 so that a drive shaft 43 penetrates the cover plate 16 or an inserted element of the cover plate. The step motor 44 serves to drive the link plate 31 and thereby both draw-down elements 12, 13 such that during rotation of the shaft 43 and thereby of the pinion 42 in one or the other rotational direction, the rack 41 moves in one or the other longitudinal direction in accordance with the double arrow C.

Furthermore, a first switching element 46 of the position determining device 11 is fixed against rotation on the drive shaft 43 of the step motor 44 between a pinion 42 and the cover plate 16. The first switching element 46 is a disc in the form of a circular segment having a collar 47 fixed against rotation on the shaft 43 and a slim pointer or indicator 48 in the shape of a circular segment which can enter the slit 49 of a U-shaped position sensor 51 of the position determining device 11. The position sensor 51, preferably of the optical-electrical type which, however, can also be of the inductive, capacitative type or the like, is fixed in place on the cover plate 16 or its inserted element on the cam carriage 14. The arrangement is such that the first switching element 46 with its pointer 48 is disposed immediately above the upper side of the rack 41 and the position sensor 51 is disposed with its horizontally extending slit 49, open towards the switching element 46, near the rack 41. Additionally, in this way the unit containing the step motor 44, the pinion 42 and the switching element 46 can be interchanged without problems.

As can also be seen in the schematic view of FIG. 2, a second switching element 52 is disposed on the rack 41 having the shape of a rectangular plate 53 the maximum length of which corresponds to half the length, preferably a little less than half the length of the rack 41. However, according to FIGS. 1 and 2, the thin plate 53 is wider and the rack 41. The arrangement is such that the second switching element 52 is disposed near the first switching element 46 and parallel to it, the part 54 of the plate 53 extending beyond the edge of the rack 41 ending in about the same alignment as the free front edge of the pointer or indicator 48 of the first switching element 46, so that both switching elements 46 and 52 can enter the slit 49 of the position sensor 51 to the same depth.

In accordance with FIG. 2, in this exemplary embodiment the second switching element 52 is disposed on the right part of the rack 41 which is in a basic position in accordance with FIG. 3, the plate 53 extending from the respective end of the rack 41 to a small distance away from the position sensor 51. The pointer 48 of the first switching element 46 is disposed in a basic position such that its front edge 56, oriented away from the second switching element 52, lies in the plane 57 extending vertically thereto of the light beam of the position sensor 51 and therefore is just touched by it. If the drive shaft 43 of the step motor 44 turns in the direction of the arrow D, the first switching element 46 turns to the left through the position sensor 51, the rack 41 with the second switching element 52 moving towards the left in the horizontal direction and the second switching element 52 arriving in the slit 49 of the position sensor 51. Since the width of the pointer 48 of the first switching element 46 is selected such that in the basic position the pointer 48 and the plate 53 of the two switching elements partially overlap, nothing changes in the signal emitted by the position sensor 51 after the position sensor 51 has detected the front edge 56 of the first switching element 46. During this movement the trailing draw-down element 12 is brought into certain predetermined draw-down position which depends on the amount of rotation or the number of steps of the step motor 44 in the direction of the arrow D. Even with maximum rotation, i.e., to the end stop 58 indicated in FIG. 2, the plate 53 of the second switching element 52 remains in the slit 49 of the position sensor 51, so that the same signal continues to be emitted by the position sensor 51. With this emitted signal is correlated the fact that the draw-down element 12 has been brought into the draw-down position while the draw-down element 13 remains at the comb level. It a reversal of the carriage now takes place the two draw-down elements 12, 13, must again be shifted in the opposite direction so that the draw-down element 12 which now leads is brought into the basic position and the now trailing draw-down element 13 is brought into the draw-down position. Therefore the step motor 44 is turned against the direction of the arrow D and the position sensor 51 determines, when it senses the front edge is turned out the plane 57, because of this change in signal that the casting-off elements 12, 13 are in their basic position or just have passed through it. If the step motor 44 is further turned in a direction against the arrow D, none of the switching elements 46, 52 are sensed by the position sensor 51 emits a signal opposite to one emitted during the previous state, with which signal is correlated that fact that now the draw-down element 12 is in the basic position (comb level). This emitted signal does not change across the entire shifting area (up to the other stop 59) of the draw-down position of the draw-down element 13.

In other words, with the aid of the first switching element 46, during each shift or return of the draw-down element 12 and/or 13, the reaching of their basic position is determined by means of the change of the signal emitted by the position sensor 51. It is furthermore determined which of the two draw-down elements 12 or 13 are in the draw-down position or at the comb level in accordance with the fact sensed by the position sensor 51 whether the second switching element 52 is in the range of the position sensor 51 or not within its range. It is to be understood that these signals or signal changes are processed in a CPU unit or the like. Thus it is necessary to access predetermined references marks during the rotation of the step motor 44, especially since the step motor 44 is capable of making more than one revolution, namely amost two revolutions. Furthermore the degree of overlap of the first and second switching element 46, 52 is selected such that the unavoidable play in the rack and pinion connecting linkage and other tolerances in the device are compensated for or do not have an effect on the determination of the basic position.

It is further to be understood that the above described exemplary embodiment of the invention has been given by way of example only and that further variants and improvements are possible within the scope of the invention.

What is claimed is:

1. A device for determining the position of leading or trailing draw-down elements of flat-bed limiting machines, said draw-down elements being shiftable to operate in opposite directions, said device comprising:

a single step motor for shifting the draw-down elements;

a position sensor for sensing the position of the draw-down elements;

a first switching element movable relative to the position sensor and operatively associated therewith, said first switching element serving to indicate a basic for each of the draw-down elements;

a second switching element movable by said drive means in synchronism with the first switching element and relative to the positive sensor with which it is operatively associated with one of the draw-down elements and serving to indicate the shifted position of the draw-down elements relative to the basic position.

2. The device as defined in claim 1, wherein said step motor makes more than one revolution for a displacement of the switching elements between their two end positions.

3. The device as defined in claim 1, wherein said step motor makes nearly two revolutions for a displacement of the switching elements between their two end positions.

4. The device as defined in claim 1, wherein both switching elements partially overlap during operation.

5. The device as defined in claim 1, wherein said drive means comprise a rack and pinion linkage which is reciprocated by said motor, wherein said second switching element is rigidly coupled to said rack, said second switching element having a length corresponding to a partial length of aid rack, and wherein the first switching element is fixed against rotation to the drive shaft of said step motor in the area of the pinion.

6. The device as defined in claim 5, further comprising:

a link plate and guide element provided for each draw-down element wherein the rack is rigidly connected to each link plate.

7. The device as defined in claim 5, further comprising:

a cover plate for said switching elements, wherein said step motor, said first switching element and said pinion are disposed at the front of the cover plate so as to be easily interchangeable.

8. The device as defined in claim 3, wherein the first switching element comprises a disk in the form of a circular segment and the second switching element comprises a rectangular plate overlap in the position determining said basic position.

9. The device as defined in claim 8, wherein the area of overlap of the disk and plate is greater than the maximum play of the rack and pinion linkage and its maximum permissible tolerance.

* * * * *

UNITED STATES PATENT AND TRADEMARK OFFICE

CERTIFICATE OF CORRECTION

PATENT NO. : 4,774,818

DATED : October 4, 1988

INVENTOR(S) : Jurgen Ploppa, Franz Schmid, Hans-Gunter Haltenhof

It is certified that error appears in the above-identified patent and that said Letters Patent is hereby corrected as shown below:

Claim 1, column 6, line 3, "limiting" should be changed to -- knitting --; and line 13, between "basic" and "for" insert -- position --.

Claim 5, column 6, line 36, "aid" should be changed to -- said --.

Claim 8, column 6, line 53, between "plate" and "overlap" insert --, and wherein the disk and plate --.

Signed and Sealed this

Fourth Day of April, 1989

*Attest:*

*Attesting Officer*

DONALD J. QUIGG

*Commissioner of Patents and Trademarks*